US006609715B2

(12) United States Patent
Anthony

(10) Patent No.: US 6,609,715 B2
(45) Date of Patent: Aug. 26, 2003

(54) GAME UTILIZING THE SENSE OF TOUCH AND MEMORY

(76) Inventor: Christopher L. Anthony, 54 E. 7th St., Tracy, CA (US) 95376

( * ) Notice: Subject to any disclaimer, the term of this patent is extended or adjusted under 35 U.S.C. 154(b) by 0 days.

(21) Appl. No.: 09/921,227

(22) Filed: Aug. 1, 2001

(65) Prior Publication Data

US 2001/0052672 A1 Dec. 20, 2001

Related U.S. Application Data

(63) Continuation of application No. 09/074,996, filed on May 8, 1998.

(51) Int. Cl.[7] ..... A63F 9/00

(52) U.S. Cl. ..... 273/447; 434/259; 206/315.1; 206/562

(58) Field of Search ..... 273/236, 140, 273/293, 440, 459; 434/259; 206/304.2, 315.1, 557, 560, 562, 563

(56) References Cited

U.S. PATENT DOCUMENTS

| | | | | | |
|---|---|---|---|---|---|
| 2,890,527 | A | | 6/1959 | Benditt | 35/8 |
| 3,484,105 | A | | 12/1969 | Winston | 273/1 |
| 3,582,075 | A | | 6/1971 | Glass et al. | 273/95 |
| 3,623,723 | A | | 11/1971 | Helbach | 273/1 R |
| 3,667,759 | A | | 6/1972 | Barr | 273/152.1 |
| 3,929,332 | A | | 12/1975 | Kidd | 273/1 M |
| 3,980,298 | A | | 9/1976 | Breslow | 273/1 R |
| 3,999,519 | A | * | 12/1976 | Rodemeyer | |
| 4,387,897 | A | | 6/1983 | Andersen | 273/276 |
| 4,468,030 | A | * | 8/1984 | Allen | |
| 4,685,672 | A | | 8/1987 | Fillers | 273/1 R |
| 4,733,863 | A | | 3/1988 | Novotny | 273/1 R |
| 4,795,351 | A | | 1/1989 | Vermette | 434/258 |
| 4,840,374 | A | | 6/1989 | Skinner | 273/1 |
| 5,094,465 | A | | 3/1992 | Dawson | 273/429 |
| 5,131,101 | A | * | 7/1992 | Chin | |
| 5,143,102 | A | * | 9/1992 | Blaul | |
| 5,152,535 | A | | 10/1992 | Roberts | 273/249 |
| 5,288,084 | A | | 2/1994 | Miller | 273/440 |
| 5,498,394 | A | * | 3/1996 | Matschke | |
| 5,529,311 | A | | 6/1996 | Johnson | 273/440 |

* cited by examiner

*Primary Examiner*—William M. Pierce
(74) *Attorney, Agent, or Firm*—Henneman & Saunders; Larry E. Henneman, Jr.

(57) ABSTRACT

This invention is a family table game, which has the function to become portable. It develops ones ability to identify detailed play pieces 24 by the sense of touch, exciting a players mental ability toward learning about these objects, challenging players sensory perceptions and mental imaging skills while improving finger dexterity. The game uses miniature or larger than life renditions of well known objects, man or nature created, as game pieces 24 played with three dimensional embossed knowledge cards 26. Game pieces sit in a circular, dome shaped container FIG. 1 out of view of player. Player spins card housing 30 (holding the interchangeable game cards 26) which stops randomly under view window 32. Player views or feels raised relief images on card 26 or reads corresponding descriptive text, starts timer 14 and begins searching through container (FIG. 4), using the sense of touch to find matching play pieces 24, earning points for each piece found in time. Player removes card 26 finding educational information about corresponding game pieces 24. This game associates learning with playtime, adding a sensory input often overlooked or taken for granted, educating players during a game environment. It thus improves a players ability to comprehend information about game pieces 24 and also enhances players mental imaging abilities, while improving hand-mind coordination. This game has the ability to grow in that purchasers of the game could by different sets of game pieces 24 and playing cards, of different levels of difficulty, thus expanding their library of components and entertainment.

21 Claims, 3 Drawing Sheets

Fig.1
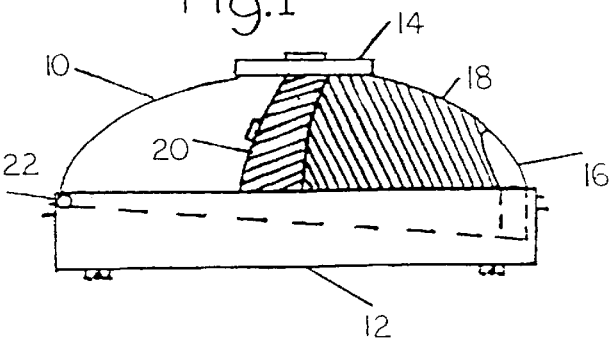
Fig.1A
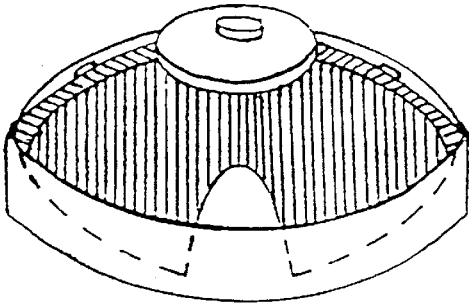
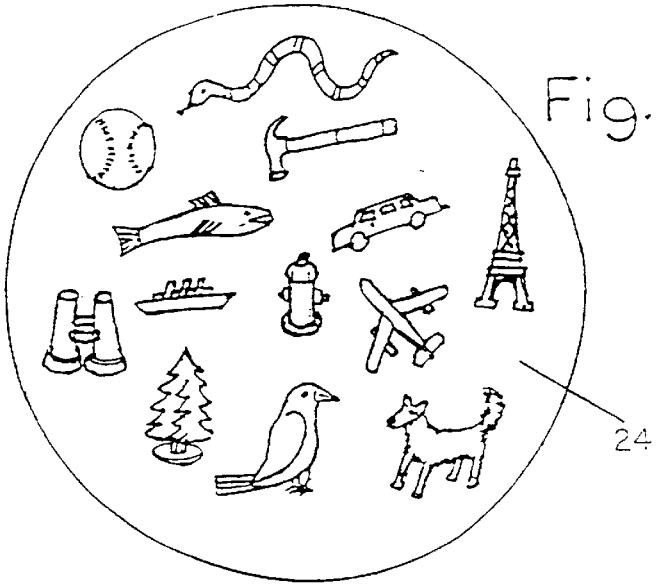
Fig. 2
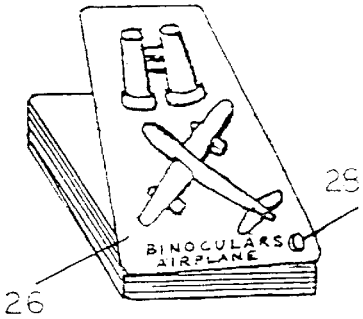
Fig. 3
Fig. 4
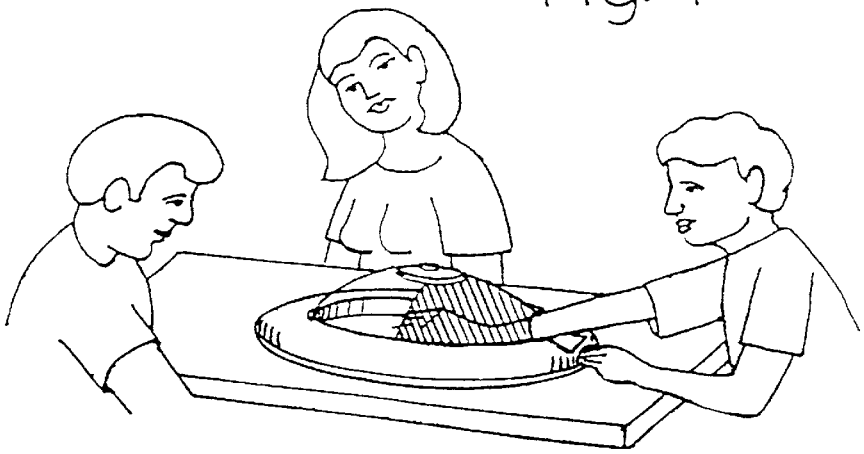

GAME UTILIZING THE SENSE OF TOUCH AND MEMORY

RELATED APPLICATIONS

This application is a continuation of copending U.S. patent application Ser. No. 09/074,996 filed on May 8, 1998 by the same inventor, which is incorporated herein by reference in its entirety.

BACKGROUND—FIELD OF INVENTION

This invention relates to a game which most specifically utilizes the sense of touch, memory and sight as an avenue to entertain and educate while improving sensory abilities, finger dexterity, cognitive capacity and mental imaging skills.

BACKGROUND—PRIOR ART

Upon conducting the patent search, a number of related patents were found. Some were similarly based on the theme of touch, while others did not apply to this patent. The following is a list describing those which most closely relate to this patent.

U.S. Pat. No. 3,484,105 to Winston (1969) discloses a game in which three dimensional objects are identified by touch and then selected to match a visual illustration of the object on a playing card. However the objects in Winston's game are described as simple geometric shapes and letters, having no interesting historical or educational value. As such his objects are extremely limited in scope and tactile diversity. Also, a visual illustration is used as the only means to inform the player of which objects to search for by touch. This eliminates the potential to utilize other sensory perceptions to be used as input. By using only a single means as input to the brain there lies no possibility to create and strengthen cerebral cortex connections between the brain, which would not only greatly enhance the play experience but also provide higher sensory stimulation and development. Another factor to point out is that Winston's game incorporates the use of an enclosed game apparatus with multiple hand apertures so that as many players as desired could play. This poses two problems in that the actual apparatus, when manufactured, would have to be large enough to accommodate this multitude of unspecified hand apertures creating an unnecessarily bulky game container, and if more than one player's hands are using the apparatus simultaneously, they would conflict with one another's ability to find and identify game pieces within the game container. Finally, Winston's game apparatus is described as entirely opaque in order to successfully conceal the pieces inside from view. However, this eliminates the exciting possibility of other inactive players observing an active player searching for pieces.

U.S. Pat. No. 5,288,084 to Miller (1994) discloses a game which relies on the sense of touch of unseen geometric objects placed inside a obscure container and requires three players in the form of a visual interpreter, a tactile interpreter and a judge. The judge arranges the objects within the container, the tactile player then feels the concealed arrangement and describes it to the visual interpreter who must then sketch what was described by the tactile interpreter. The objects are not represented individually, but as a group or arrangement. The objects are not identified and withdrawn from the container in conjunction to a representation on a playing card. Also, the players do not play individually and develop their own sensory strengths, but are required to form a team in order to play, which limits the opportunity to play and also the chance to enhance individual skills.

U.S. Pat. No. 3,980,298 to Breslow (1976) discloses a game which utilizes a number of different shaped playing pieces in conjunction with playing cards corresponding to the pieces with visual illustrations. It incorporates several apparatus to obscure these pieces, requiring more storage and a higher probability of them becoming lost. It does not rely on the sense of touch to identify the objects, but rather on memory on behalf of the individual player to remember which objects are concealed under which apparatus. This method of identifying the objects becomes more like a guessing game as they are shifted to different positions and does not require much skill or strengthen any sensory abilities.

U.S. Pat. No. 4,840,370 to Skinner (1989) discloses a game that utilizes the sense of touch that incorporates the use of a hollow container that is open on either end with a partition in the middle having aperture matching the shape of simple geometric blocks. A player manipulates the objects through the appropriate aperture using only the sense of touch. It does not incorporate the use of complex objects or any form of card or other such method to be used to help identify individual objects. It is a very basic and monotonous exercise that could quickly exhaust its limited resource of objects used. Because objects are not identified by the sense of touch in response to some method to describe or depict those objects, it does not relate to this game.

U.S. Pat. No. 2,890,527 to Benditt (1959) disclose a game that utilizes a large number of miniature renditions of well known objects. However, it does not rely on the sense of touch as a means to identify those objects, but rather on visual observation, and therefore does not apply to this game.

U.S. Pat. No. 5,529,311 to Johnson (1996) discloses an game in which multiple players identify a separate areas of a single object within an obscured structure by the sense of touch simultaneously. Players are not able to feel the entire object, only a small portion of it.

The following describes other patents discovered in the patent search that do not relate to this game. U.S. Pat. No. 4,685,672 to Fillers (1987) discloses a guessing game involving players guessing amounts of concealed objects. U.S. Pat. No. 3,582,075 to Glass and Breslow (1971) discloses a word game that utilizes alphabet letters and a catapult that launches individual letters. Players must try to identify a letter in mid air and catch it if they can use it to spell a word with other letter they have. This patent only relies on the sense of touch in that players select letters from a concealed container and upon obtaining them, must decide which one they will get rid of by using the catapult. U.S. Pat. No. 5,094,465 to Dawson (1992) discloses a game which is based on shape recognition with the use of clue cards that decrease in point value as more clues are revealed to identify an object. It does not utilize objects in corresponding to the clues on the cards. U.S. Pat. No. 4,795,351 to Vermette discloses a game that allows player to perform manual operations within a visually obscured enclosure for the purpose of rehabilitation and evaluation. U.S. Pat. No. 3,623,723 to Helbach (1971) discloses a finger manipulation game where three dimensional objects are placed around the fingers of a player and then manipulated to match randomly positioned corresponding objects. U.S. Pat. No. 4,387,897 to Andersen (1983) discloses a game in which the playing pieces are in groups of geometric shapes in successively decreasing sizes. U.S. Pat. No. 4,733,863 to Novotny (1988)

discloses a confectionery guessing game. U.S. Pat. No. 5,152,535 to Roberts (1992) discloses a bible quiz game. U.S. Pat. No. 3,929,332 to Kidd (1975) discloses a game utilizing two sets of cards that are to be matched together. The cards are mounted in either a cylindrical or rectangular shaped frame within a rotatable holder.

My own patent describes a game which utilizes a single, multi-purpose game apparatus, game pieces which are complex, educational and unlimited in number and requires the use of the sense of touch as a means to identify individual pieces in response to various sensory stimulus. Nevertheless all of the relevant games mentioned above suffer from a number of disadvantages:

(a) They utilize only one form of sensory input to be offered as a clue to which piece to search for by touch, in the form of a visual representation on a card. This feature completely eliminates the exciting possibility of utilizing other senses, which would not only enhance the play experience greatly, but would also strengthen the connection between these senses and help develop them further.

(b) They use game pieces that are limited in range in the respect that they do not utilize the vast number of possibilities that exist and do not take into consideration the powerful educational role these piece can have.

(c) They incorporate the use of bulky and awkward containers that when manufactured would require not only more material to create, but would also require further research and development to determine the most viable form, both of which would greatly increase production costs.

(d) They do not possess the capability for continued expansion by adding on to the game by purchasing new unique themed sets. This feature would allow the game to continually evolve and further educate and entertain its players, making the game more marketable with a higher profit potential.

OBJECTS AND ADVANTAGES

This game overcomes and expands a basic concept of a game based on the sense of touch to a more exciting, educational and marketable game.

This game seeks to limit the use of complicated devices by utilizing a single multiple purpose device. This game comprises an apparatus with a single aperture that incorporates the use of a self adjusting opening to accommodate different hand sizes and has the ability to be rotated to each active player in turn, making it possible for the game to be played with as few or many players desired.

This game seeks to add another dimension that creates further entertainment and excitement in that it includes a transparent window on the opaque play container, which will have a movable sliding opaque window to allow the choice of whether the non-active players can observe the active player search.

This game intends to employ an unlimited conglomeration of objects in the sense that any object known to man, imaginary or real would be represented as miniature or larger than life renditions, not just limited to simple shapes. Thus, the game is dual purpose: the sense of touch being the avenue used to excite ones mental ability, learning about each game piece, while improving ones sensory abilities.

Because this invention is designed to make use of a limitless number of specific and detailed objects it has the possibility to expand by adding on other sets of objects/cards to give the game an evolutionary nature and expanding library of information. Having a vast number of potential playing pieces would further increase educational and difficulty levels, and add to the excitement and educational potential of the game and would therefore allow the game to be highly commercial and profitable.

Particularly, the game apparatus includes an unlimited multitude of different renditions of three dimensional objects. These objects can include anything common and well known, man made or nature created and having some history or educational value. They can come in themed sets of alike objects such as, but not limited to : Famous landmarks (such as the Eiffel tower, Egyptian pyramids, Washington monument, Leaning Tower of Pisa, Empire State Building, Trans-America Building, etc.), natures creatures (such as dinosaurs, birds, sea life, wildlife, endangered species, insects and microscopic entities etc.), vehicles (such as airplanes, cars, trucks, trains, space craft, etc.), celestial bodies, sporting equipment, tools, military equipment, kitchen accessories, doll-house miniatures, toys and fantasy themes (such as aliens and objects from their world or characters from mythology as well as from movies and television programs). The fact that there is an unlimited range of possible playing pieces will keep the game expanding as new sets are added, thus increasing the difficulty and skill level.

A great advantage of this game is the fact that a multitude of objects can be utilized. Many of these objects are already mass-produced by major toy companies and include doll accessories, miniature vehicles, sets of plastic animals or insects, party favors and many other plastic miniature toys. There is a great element of fun just in collecting new sets of miniature objects that are familiar, educational and novel. This would add to the complexity of the game and keep it ever changing to decrease any eventual boredom associated with "learning" a limited number of pieces, as in the above mentioned previous patents. This game uses only one play apparatus which is easily assembled, portable and functionally houses the playing cards and has an interesting visual appearance. It has a much simpler apparatus, unlimited objects and could easily be mass-produced.

This game has a high commercial value in that it is entertaining, educational and a progressive table game. It is expandable, utilizes memory capacity and deepens sensory perception skills.

The most important feature of this game is that it seeks to link both sides of the brain, creating a pathway through the cerebral cortex by employing several senses simultaneously. It will incorporate unique raised relief cards that players touch to gain increased tactile awareness, instead of relying on visual stimulation alone as an input. It also forces players to depend on memory without relying on a visual image, in that the cards can be obscured with the result being that only descriptive text will be offered as input. In these ways, the player relies on a number of sensory clues in their tactile search for pieces.

The cards in this game have at least one or more object(s) represented on them which will persuade the player to contemplate and distinguish more than one object at the same time. Having a number of objects to search for also allows for choices on the players part and increases the chance of kinesthetic identification.

The game can be used as a toy or as a learning device. It not only involves the element of chance, but also utilizes and strengthens mental imaging skills in the fact that multiple sensory perceptions are used simultaneously, creating valuable cerebral cortex cross inputs on behalf of the individual players. Players also increase their knowledge by learning relevant facts about numerous educational and historical objects.

This game allows players to utilize a skill we all posses but often overlook or take for granted, the sense of touch. The present invention has the ability to build not only skill but confidence, in the young, the disabled and players of all ages and skill levels. It has a capability for a wide field of possible players, making it a good family table game. This fun game associates learning with playtime and encourages each player's comprehension of information about game pieces. It challenges a player's mental imaging abilities while improving hand-mind coordination and finger dexterity. Players enjoy the experience of distinguishing the different pieces from one another almost seeing through their fingers to find a piece.

Further objects and advantages of my invention will become apparent from a consideration of the drawings and ensuing description.

DESCRIPTION OF THE DRAWINGS

With the above as well as other objects and advantages outlined and depicted which will become more apparent as the description proceeds, this invention comprises the novel configuration, association and organization of parts as herein after are more fully described and as generally pointed out in the appended claims, reference being had to the accompanying drawings wherein like numbers are referred to in like parts in several views in which:

FIG. 1 is a side view of the play container of the present device including a hollow container having two parts with aperture interposed on the upper portion and including a mechanism as a timer and a mechanism to adjust the size of the aperture and a mechanism to partially or entirely obscure the upper portion of the container;

FIG. 1A is a perspective view of the play container;

FIG. 2 is a top view of an example of the differently shaped three dimensional objects that can be used;

FIG. 3 is a perspective view of the playing cards having visual raised relief images and corresponding descriptive text corresponding to the three dimensional objects thereon;

FIG. 4 is a view illustrating the general manner in which the game device is used of which the play container is the central component;

Figure 5:
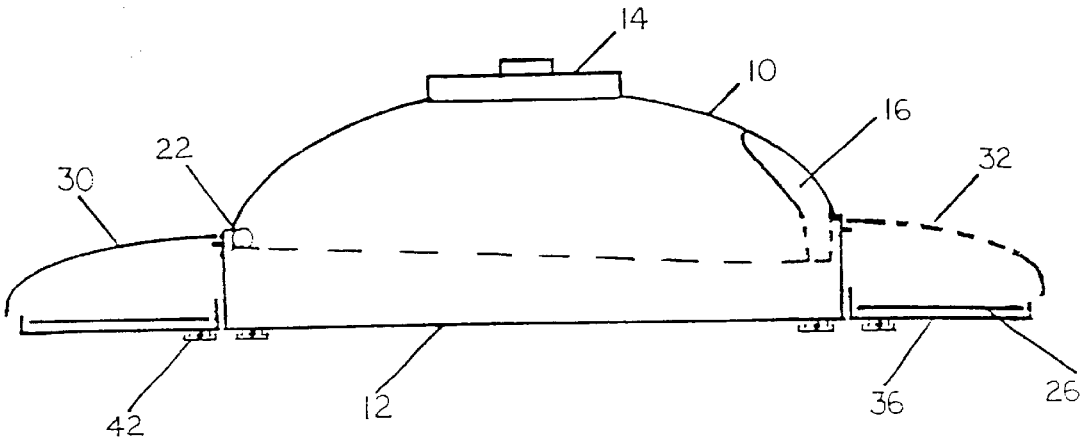
FIG. 5 is a cross sectional view of the play container installed in relation to the game skirt and the card housing with details of bearing assemblies for rotational movement.

| Reference Numerals in Drawings | |
|---|---|
| 10 dome container top | 12 circular container bottom |
| 14 timer | 16 hand opening |
| 18 opaque area | 20 sliding opaque doors |
| 22 self adjusting hinge | 24 play piece(s) |
| 26 playing card(s) | 28 metal protrusion |
| 30 game skirt | 32 viewing window |
| 34 sliding door for viewing window | 36 card housing |
| 38 opening on viewing disc | 40 molded ridge |
| 42 bearing assembly | 44 magnet |
| 46 semi circle indent | |

SUMMARY

In accordance with the present invention a game comprises a circular dome container having an adjustable hand opening and a mechanism to either partially or entirely obscure three dimensional pieces within. The dome container is installed removably within a circular rotational skirt containing a viewing area to allow players to view, read or touch a raised relief card below on a circular rotating card housing.

Description—Main Embodiment

Referring to the drawing, the game device of the present invention is illustrated as having the main component of the game a play container FIG. 1. The top of the container is a dome 10 and the bottom of the container is a circular receptacle 12 which holds the play pieces (as shown in FIG. 2). The dome 10 attaches to the bottom 12 with a spring loaded hinge 22 which is self adjusting, for different hand sizes. The dome 10 piece slides into the bottom container 12, overlapping less at the hinge 22 point and more at the hand opening 16, which is opposite the hinge 22. This allows for different size hands to lift the dome 10, while still maintaining the concealment of the game pieces 24. The self adjusting hinge 22 absorbs most of the dome's 10 weight as each player reaches into opening 16. The bottom piece 12 is made of opaque material and measures approximately 6.5 cm. deep by 30 cm. in diameter. The top dome piece 10 is partially opaque around the hand opening 16 with the rest being transparent. Attached to the dome 10 are two sliding opaque doors 20 which rest underneath the opaque side of the dome 10 when not in use and may be slid around to entirely cover the transparent side of the dome 10, depending on desired play. The dome 10 is approximately 30 cm. in diameter, being just slightly smaller in diameter than the bottom piece 12 in order to slide into it. The hinge side of the dome 10 measures approximately 13 cm. deep and increases in depth along it's circumference toward the hand opening 16 where it is approximately 17 cm. deep (FIG. 1). On top of the dome 10 rests a mechanical or digital timer 14. A mechanical or digital timer 14 with multiple time sets is mounted on the top of the dome 10. The timer 14 has the option of using preset times such as 1 minute, 45 seconds, 30 seconds, etc., or using start and stop buttons to record individual times to use in scoring.

Figure 8:
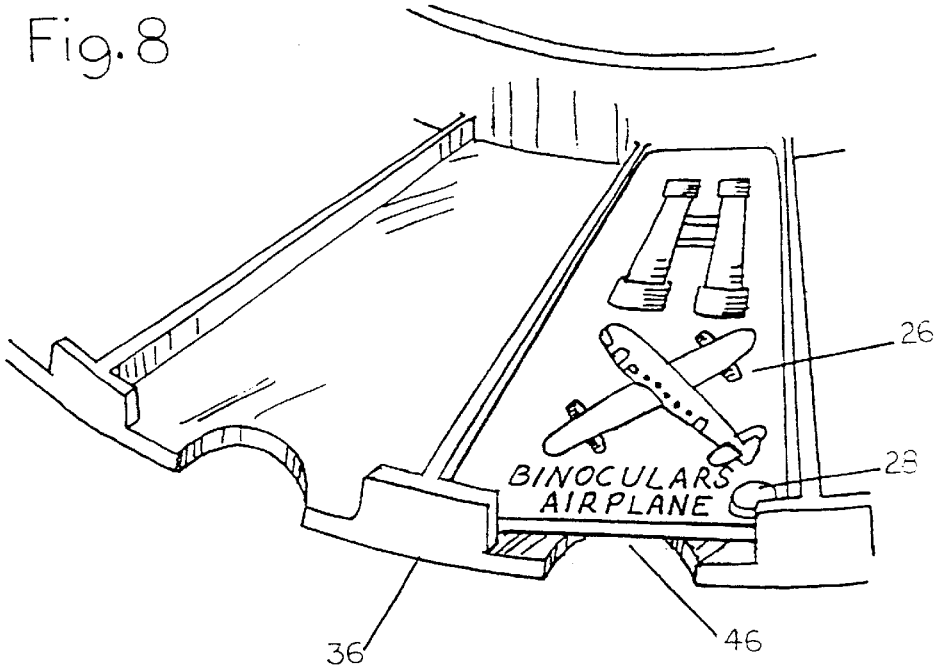
FIG. 8 is a perspective view detailing the configuration of the card housing that holds the playing cards including a depression to allow a finger to spin the card housing rotationally and the manner in which the playing cards are incorporated in to the card housing.

The play pieces 24 have a set of corresponding playing cards 26. Each card 26 is embossed on the top with a raised relief detailed image of the corresponding piece(s) 24 with relative descriptive text on the lower edge of the card 26 and questions on the reverse that relate to the images on the front of the card 26. Each card 26 displays at least one raised relief image of a particular play piece 24, with different themed sets on each card or set of cards 26. The cards 26 are approximately 9 cm. long and about 6.5 cm. on the widest side and are wedge shaped to fit into a round card housing 36 (FIG. 8).

The game skirt 30 embodies a wedge shaped transparent piece of plastic that functions as a viewing window 32 to reveal a card 26 beneath. The viewing window 32 is slightly larger than a single card 26. The game skirt 30 rests approximately 6 cm. above the card housing 36 at the inside circumference, sloping lower at the outer circumference to approximately 2 cm. The game skirt 30 is approximately 30 cm. diameter inside (corresponding to the diameter of the container bottom 12)and the outside diameter is approximately 52 cm. and covers the card housing 36 that holds the playing cards 26.

Figure 6:
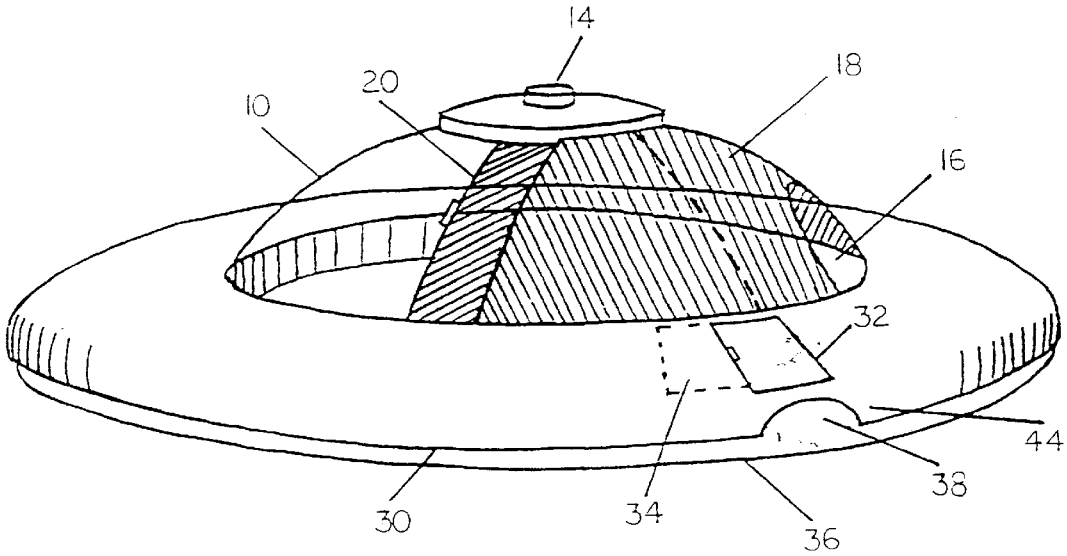
FIG. 6 is a perspective view showing the entire of the game of the present invention including details of the viewing window, timing mechanism, dome obscuring mechanism and card obscuring mechanism.

The game skirt 30 has an opening 38 on the outer edge that measures approximately 4 cm. high by 7 cm. wide and is parallel to the viewing window 32 that allows players to reach in and touch the raised relief image on the playing card 26 with one hand while searching for a game piece 24 in the dome 10 with the other hand. The game skirt 30 has a sliding door 34 (FIG. 6) mounted on the underside, next to the viewing window 32 that can be closed over the viewing window 32. The door 34 is of the same proportions as the viewing window 32 and is used for the purpose of obscuring the visual image on the card 26 while still revealing the descriptive text through the opening 38 on the viewing disk 30.

A small magnet 44 is installed on the inside edge of the game skirt 30 on the right side of the opening 38. Each card 26 has a raised metal protrusion 28 on the bottom right hand side that when the card housing 36 is spun, the metal protrusions 28 on the cards 26 pass by the magnet 44, thus slowing the rotation of the card housing 36 and eventually stopping it with the result being a random exposure of an individual card 26 beneath. If a card 26 is removed from the game board 36 [as when the piece(s) 24 represented on that particular card 26 are already drawn out of dome 10], then the card housing 36 will spin freely by that particular empty section, on to ones with cards 26 still in them.

Figure 7:
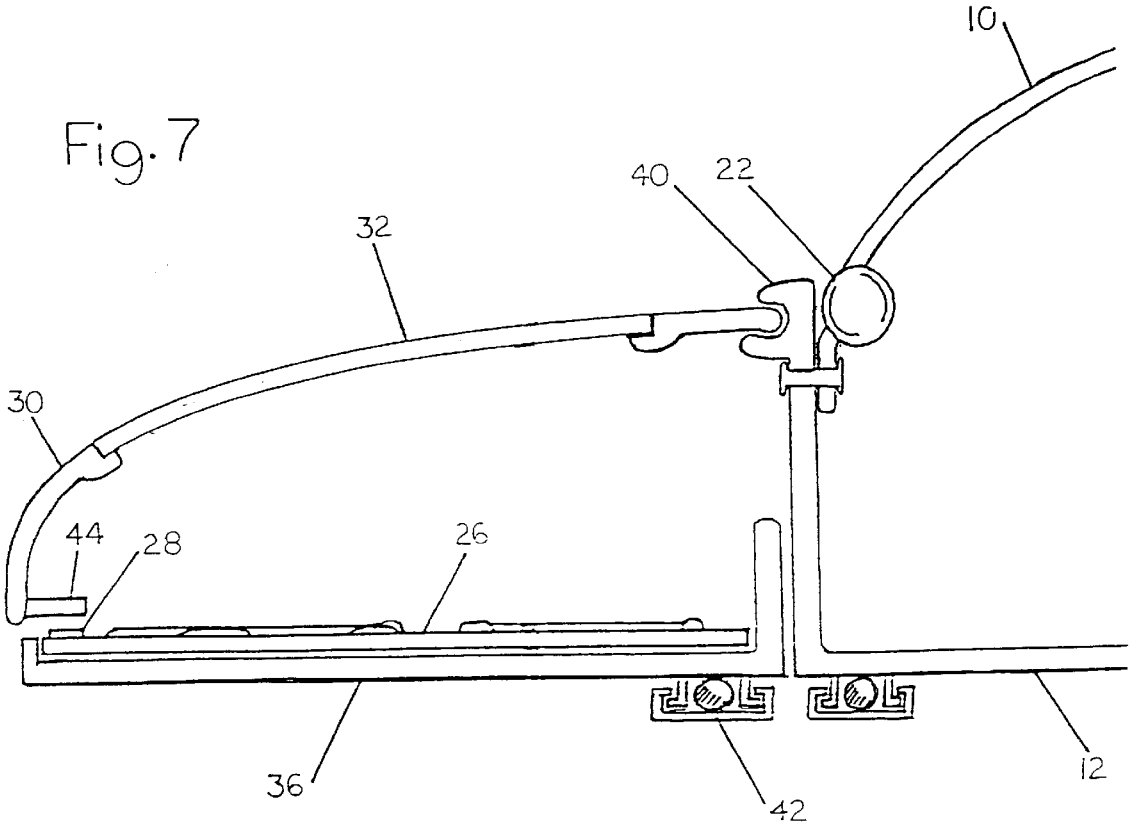
FIG. 7 is a detailed cross sectional view of the method in which the game skirt and card housing install in relation to the central play container.

The bottom piece 12 of the container has two sets of molded ridges 40 at the top edge. The ridges are where the game skirt 30 attaches to the upper edge of the 12 play container (FIG. 7). The dome 10 in conjunction with container bottom 12 and recognized as a play container configuration (FIG. 1) fit inside of the game skirt 30 and card housing 36. The play container configuration is removable for the option to be used as a portable version.

The game skirt 30 is able to slide inside of the molded ridges 40 on the play container (FIG. 7), allowing the viewing window 32 to move right or left of the hand opening 16 in the dome 10 depending on right or left hand play, for the comfort of the player.

The card housing 36 is slightly less than 52 cm. in diameter, and has separate compartments for each card 26 to rest in, with a semi-circle indent 46 corresponding to each card compartment to allow for easy installation and removal of the cards 26 as well as functioning as a tab that a player's finger may easily push to set the card housing 36 in a rotational inertia (FIG. 8). This rotational inertia is provided by the card housing 36 being mounted on a bearing assembly 42 (FIG. 7). The bearing assembly 42 allows the card housing 36 to spin around the play container FIG. 1 (consisting of the dome 1 and bottom 2 configuration) and underneath the game skirt 30. The play container (FIG. 1) also has the ability to rotate independently by also being mounted on a bearing assembly 42.

Operation—Main Embodiment

To set up the game, players assemble card housing 36 attaching to container bottom 12 with dome top 10 attached. Players install cards 26 onto card housing 36 by placing them into the empty spaces until all are filled. The game skirt 30 is then installed around the dome container (FIG. 1) over the card housing 36 holding the cards 26 (see FIG. 5). All three-dimensional pieces 24 corresponding to images on cards 26 are placed into the dome container (FIG. 1). Game is ready for play.

There are different variations of play that players can decide on to change the challenge of the game, that will not change the main object of the game which is searching for objects based on the sense of touch. For example, the dome 10 can be either entirely obscured using the sliding opaque doors 20, preventing even inactive players from observing, thus raising the difficulty level, or the dome may only be partially obscured toward the active player, allowing for observation on the part of the inactive players, raising the excitement level and giving inactive players added readiness when it is their turn which can be particularly valuable when first becoming familiar with this experience.

There are basically three different modes that can be played either separately or in conjunction with each other. These are sight/touch, touch/touch and memory/touch.

(a) Sight/touch allows the players to visually observe the images of the play pieces 24 on the cards 26. After these visual observations the player then enters his hand into the opening 16 in the dome 10 and searches entirely through the sense of touch, for individual pieces 24, as they are obscured from his sight.

(b) The mode of touch/touch actually allows the player to physically touch the raised relief image on the card 26 and then search for the corresponding piece 24. This mode can be used in conjunction with the others, but also is particularly valuable used alone, since sightless people could play with people of sight and they would both have the same restrictions. Also, while a player touches a card 26 with their left hand, they could search for the piece 24 at the same time with their right hand, thus tying in both sides of the brain simultaneously, making an important cerebral cortex cross connection.

(c) The third mode is memory/touch, which will exercise the player's ability to remember pieces from previous plays and would be played with the visual/raised relief image on the card 26 obscured altogether, thus only revealing descriptive text corresponding to the piece(s) 24 to be searched for, an example being descriptions such as banana, apple, grapes or jet fighter, biplane, jumbo jet. Player would be forced to visualize pieces from memory instead of actually seeing or feeling it on the card 26. This mode would be particularly enhanced with the opaque doors 20 on the dome 10 closed, obscuring the pieces 24 from everyone's view and is an excellent mode for more advanced players.

To start the game, player one spins the card housing 36 to reveal a card 26 under the viewing window 32. The cards 26 have raised relief images of play pieces 24 along with identifying descriptive text of those particular pieces 24, each representing a corresponding three dimensional playing piece 24. Descriptive text on the cards 26 can be printed in any language known to man, using language corresponding to local dialects. The text could also be multi lingual to make the game more universal and educational. Players must decide in advance which mode of input will be used, either looking at visual image on card 26, feeling that image, or reading the corresponding descriptive text Player then may either hit start button on timer 14 or use a predetermined set time and inserts hand into opening 16 on dome 10 to search for pieces 24 that match those represented on the card 26. Player searches in the dome 10, utilizing his predetermined input of sight, touch or memory using nothing but the sense of touch to determine what each piece 24 in the container 12 is, using sensory perception and mental imaging to locate and identify game pieces 24. In this way, player utilizes a variety of sensory perceptions and draws upon his memory as well. The dome's 10 transparent side (with opaque doors 20 either opened or closed) points toward inactive players as they watch, while the permanent opaque side 18 faces current player. When player feels confident they have found a piece 24 matching that on the card 26 shown, they remove it from the dome 10. If it is a match, they keep the piece 24 and continue searching for other pieces 24 on the card 26 in the time allotted. If a player pulls out a non-matching piece 24 they immediately lose their turn and returns the mis-identified piece 24 to the container 12 and it becomes the next players turn. Each individual playing piece 24 has the capacity to have different point values depending on difficulty, smaller pieces being harder to distinguish could be worth more points.

As the game progresses past the second round and each player starts to collect various pieces 24, he or she will then have the option to either search for pieces 24 shown on the new card 26 or may also try for corresponding set pieces 24 from cards 26 or pieces 24 already drawn from that player's previous turns, enabling players to complete sets of pieces 24 that would be worth additional points. Any player that collects all the pieces 24 on a given card 26, will then remove that card 26 from the card housing 36 and be entitled to bonus points. Then, by answering questions about the pieces 24 on the card 26, players may receive additional points. Information in the form of trivia questions or facts is located on the reverse of each card 26. The player with the highest score will win and scoring is based on accuracy, speed, ability to collect sets and knowledge. There can be a bonus round at the end of the game where players skill and memory are really put to the test. Player starts timer 14, reaches into opening 16 and identifies pieces 24 by giving verbal descriptions as fast as possible, in a set time, without any other input (from cards 26) earning bonus points for each piece 24 correctly identified. Player may lose turn with first missed identification.

This description of the operation of this game is in a general format that could possess many variations and should therefore not be limited to the above mentioned generic directions.

Description and Operation—Alternative Embodiments

There are several alternative forms and variations that this game can take on, and by no means should be entirely limited to those mentioned above. For example, the card housing 36 and game skirt 30 could be entirely eliminated and only the dome 10 and container 12 used, with perhaps simple two dimensional cards, set in a stack. This would be much more cost effective, although it would eliminate the avenue of using the touch/touch mode of touching a raised relief card 26 while searching. The cards could also be in a holographic form for visual interest. Also, there does not necessarily have to be individual playing cards 26 set into a card housing 36, instead the images could be combined on one solid, interchangeable ring shaped card that would be installed under the game skirt 30. New sets of pieces 24 could be manufactured with a single corresponding ring shaped card which would decrease production costs and increase ease of installation, however it would eliminate the chance to commingle different sets of pieces since the set would be unchanging in conjunction with the solid card ring. The mechanical or digital timer 14 could be replaced with a digital LED display with some memory installed to store information about the pieces 24, including descriptive and factual information/questions. This would give the option to play with or without the use of visual cards, allowing for technology to handle all the necessary storage of information and further simplifying the number of components. In this way players would be prompted as to which pieces 24 to select, only in reference to a digital display and would still utilize the mode of memory:touch, wherein the player would only have his memory to use as he searches for game pieces. Also, the feature of using a magnet 44 and a metal protrusion 28 on the cards 26 as a means to randomly select a card 26 is only one example of the way this operation could be performed. For example, a traditional flicker mechanism combined with plastic protrusions as utilized in many popular board games would also perform this task adequately and since other options already exist, this operation should not be limited to the method described. Another elaboration would be the use of a frensel lense in place of transparent plastic for the viewing window 32 which would act as a magnifier, further enhancing the three dimensional appearance of the images on the cards 26.

Conclusions, Ramifications and Scope

This game has many positive advantages. It associates learning with playing making education fun. It enhances motor perceptual skills, leading to mental imaging, visualizing objects while simultaneously gaining comprehension about history and facts. It utilizes the sense of sight, touch and cognitive memory, contributing to enhanced left and right brain exchange and greater tactile identification. It is exciting in the realm of observing others search for objects they cannot see and has a great potential for growth in the ability to create numerous sets of objects for continued expansion and further exploration and progression. It can take many physical forms in that it can be a full-fledged family table game, with a spinning disk of three dimensional cards or it can become portable, by removing the game skirt and card housing and using variations on card construction (embossed three dimensional, laminated two dimensional, holographic) or it can utilize the latest technology by involving the use of a digital LED display. Even though a round or disc like form seems the most sensible it could take on other forms, perhaps octagonal, two layered or square. The description above seems the most logical, but does not limit the scope of possibilities that this game could take on and should not be limited to the particular form shown.

We claim:

1. A game apparatus comprising:

a container including a chamber, an opening to facilitate the insertion of a player's hand into said chamber, an opaque portion disposed to obstruct the view of said player into said chamber, and a transparent portion formed from a solid material and disposed to facilitate the view of another player into said chamber;

a plurality of objects for placement within and selective withdrawal from said chamber; and object selector means for identifying at least one object of said plurality of objects to be selectively withdrawn.

2. A game apparatus according to claim 1, wherein said transparent portion is disposed in a top portion of said container.

3. A game apparatus according to claim 2, wherein said top portion of said container is dome shaped.

4. A game apparatus according to claim 1, wherein said transparent portion is disposed to facilitate the view of a majority of the interior of said chamber from a position above said container.

5. A game apparatus according to claim 1, wherein:

said container includes a top portion and a bottom portion movably connected to one another; and said opening includes a recess formed in one of said top and bottom portions;

whereby said opening is adjustable in size by the relative movement of said top portion and said bottom portion.

6. A game apparatus according to claim 5, wherein said top portion is pivotally connected to said bottom portion at a point opposite said opening.

7. A game apparatus according to claim 1, wherein:

said object selector means includes a plurality of cards, each card corresponding to at least one of said objects.

8. A game apparatus according to claim 7, further comprising an annular tray formed to encircle said container and to receive said cards.

9. A game apparatus according to claim 8, wherein said cards are trapezoidal in shape.

10. A game apparatus according to claim 8, further comprising a skirt formed to cover at least a portion of said tray formed to receive said cards.

11. A game apparatus according to claim 7, wherein said cards are integrally formed in an annular ring.

12. A game apparatus according to claim 11, further comprising a skirt formed to cover at least a portion of said annular ring.

13. A game apparatus according to claim 7, wherein said cards include raised images.

14. A game apparatus according to claim 1, further comprising an obscuring mechanism to selectively block the view through said transparent portion.

15. A method of playing a game comprising:

providing a container including a chamber for holding a plurality of objects, an opening to facilitate the insertion of a players hand into said chamber, an opaque portion disposed to obstruct the view of said player into said chamber, and a transparent portion disposed to facilitate the view of a second player into said chamber when said second player is positioned opposite said first player;

identifying one of a plurality of objects to be selectively removed from said container by said player;

said player attempting to remove the identified object from the container with the inside of said container not visible to said player; and said second player observing the inside of said container as said player attempts to remove said identified object.

16. A method according to claim 15, wherein said step of identifying said object includes selecting a card corresponding to said object from a plurality of cards.

17. A method according to claim 16, wherein said step of selecting a card includes spinning a card assembly.

18. A method according to claim 17, wherein said card assembly includes an annular ring having said plurality of cards formed integrally therein.

19. A method according to claim 16, wherein said step of identifying said object further includes evaluating said card without the aid of sight.

20. A game apparatus comprising:

a container for holding a plurality of objects in the interior of said container;

a plurality of detached objects for selective withdrawal from said container as an object of said game; and selective viewing means for preventing visual access to said interior of said container by a first player while providing visual access to said interior of said chamber by a second player seated opposite said first player.

21. A game apparatus according to claim 20, further comprising identifying means for identifying one of said objects for selective removal from said container.

* * * * *